US012661576B2

(12) United States Patent
Petrovs et al.

(10) Patent No.: US 12,661,576 B2
(45) Date of Patent: Jun. 23, 2026

(54) CARD SHOE

(71) Applicant: Evolution Malta Limited, St. Julians (MT)

(72) Inventors: Vitalijs Petrovs, Riga (LV); Raivis Rengelis, Riga (LV)

(73) Assignee: Evolution Malta Limited, St. Julians (MT)

( * ) Notice: Subject to any disclaimer, the term of this patent is extended or adjusted under 35 U.S.C. 154(b) by 670 days.

(21) Appl. No.: 18/095,874

(22) Filed: Jan. 11, 2023

(65) Prior Publication Data

US 2023/0218980 A1 Jul. 13, 2023

(30) Foreign Application Priority Data

Jan. 12, 2022 (EP) ..... 22151187

(51) Int. Cl.
*A63F 1/14* (2006.01)
*A63F 1/10* (2006.01)

(52) U.S. Cl.
CPC . *A63F 1/14* (2013.01); *A63F 1/10* (2013.01)

(58) Field of Classification Search
CPC ..... A63F 1/067; A63F 1/14; A63F 1/10
USPC ..... 273/149 R
See application file for complete search history.

(56) References Cited

U.S. PATENT DOCUMENTS 2,048,942 A * 7/1936 Mcconnell ..... A63F 1/14 273/149 R
4,457,512 A * 7/1984 Stevenson ..... A63F 1/14 273/148 A
4,750,743 A * 6/1988 Nicoletti ..... A63F 1/14 271/160
6,402,142 B1 * 6/2002 Warren ..... A63F 1/14 273/148 R
9,833,691 B2 * 12/2017 Bérubé ..... A63F 1/14
2006/0279040 A1 12/2006 Downs, III et al.
2009/0121429 A1 5/2009 Walsh
2014/0042697 A1 2/2014 Bérubéet al.
2014/0291930 A1 * 10/2014 Berube ..... A63F 1/14 273/149 R
2015/0014925 A1 * 1/2015 Miller ..... A63F 1/14 273/148 R
2022/0233735 A1 * 7/2022 Whittemore ..... A61L 2/10
2023/0211228 A1 * 7/2023 Spiridonovs ..... A63F 1/14 273/149 R

FOREIGN PATENT DOCUMENTS

WO 2007075600 A2 7/2007
WO 2016049619 A1 3/2016

OTHER PUBLICATIONS

European Patent Office, Extended European Search Report, Application No. 22151187.6, Jul. 6, 2022, 7 pages.

* cited by examiner

*Primary Examiner* — Dmitry Suhol
(74) *Attorney, Agent, or Firm* — Quarles & Brady LLP

(57) ABSTRACT

A card shoe and a method of manufacturing the card shoe. The card shoe includes a housing with an elongated body and a receptacle for receiving playing cards. The housing includes a first plate and a second plate. An opening between the first plate and the second plate for removing the playing cards from the receptacle is adjustable by changing a separation between the first plate and a distal end portion of the second plate.

20 Claims, 8 Drawing Sheets

CARD SHOE

CROSS REFERENCE TO RELATED APPLICATIONS

This application claims priority to European Patent Application No. EP 22151187.6 filed Jan. 12, 2022, the disclosure of which is incorporated herein by reference in its entirety and for all purposes.

TECHNICAL FIELD

The present disclosure relates to a playing card shoe for dealing a plurality of playing cards and more specifically to a card shoes having an adjustable opening for removal of the playing cards from the card shoe.

BACKGROUND

Playing card shoes are commonly used to deal playing cards to the players in card games both under real world as well as in online casino settings. Card shoes typically have a housing which is adapted to receive multiple decks of playing cards which conventionally have fifty two playing cards per deck. The cards are arranged inside the housing of the card shoe and via an opening which is typically arranged at the front of the card shoe facing a dealer, are pulled out manually and distributed to the players during the card game.

Some card shoes may also comprise means for guiding the playing cards towards the card-extraction opening of the card shoe e.g. by means of a wedge-like assembly disclosed in WO 2007/075600 pushing the cards towards the opening.

Several other variations of card shoes developed in the art have introduced changes to the card shoes which both functionally and aesthetically have altered and specialized the card shoes used for games such as poker, blackjack, etc. Design changes and features have been introduced to card shoes to e.g. minimize the possibilities of cheating such as card counting by the players, or making it easier for the dealer to distribute the cards to the players. Many of these designs however still suffer from drawbacks which make the operation of the card shoe by the dealer cumbersome and more often than not error-prone. For instance, in many of the conventional card shoes, the mere act of pulling the cards from the card shoe can be become a serious issue. Several reasons such as insufficient and uncontrolled forcing of the cards towards the opening or the fact that the dealer may not be able to have a controlled contact with each playing card being pushed towards the card-extraction opening of the housing might contribute to an unpleasant and even unfair game play.

Therefore, there is a need for improvements in the field of design and operation of card shoes for playing card games to make the card distribution easier, faster and much more controlled compared to the conventional card shoe designs.

SUMMARY

It is accordingly an object of the present invention to improve the current state of the art and to mitigate at least some of the above-mentioned drawbacks.

These and other objects are achieved by providing a card shoe and a method of manufacturing a card shoe as defined in the appended independent claims. The term exemplary is in the present context to be understood as serving as an instance, example or illustration.

According to a first aspect of the present invention, there is provided a card shoe comprising a housing having an elongated body. The housing of the card shoe comprises a receptacle for receiving a plurality of playing cards. The housing further comprises a first plate arranged on a support platform at a first angle with respect to a horizontal reference plane of the support platform. The first plate has a first surface for supporting the plurality of playing cards. The housing further comprises a second plate arranged adjacent to a front end portion of the first plate at a second angle with respect to the first plate. The second plate comprises a distal end portion arranged spaced apart from the first plate, such that an opening for removing the plurality of playing cards from the receptacle is formed at the front end portion of the first plate between the first surface of the first plate and a first surface of the distal end portion of the second plate facing the first surface of the first plate. Further, the first plate is configured such that the opening between the first plate and the second plate is adjustable by changing a separation between the first plate and the distal end portion of the second plate.

According to some aspects and embodiments, the first plate may comprise a protruding ridge at the front end portion of the first plate, extending outward from the opening between the first plate and the second plate. The ridge may comprise at least one corner portion slanted at an angle with respect to a longitudinal extension of the first plate. The angle could be any angle other than a right angle. This way the dealer can retrieve the playing cards faster from the card shoe and the speed of card distribution is noticeably increased.

According to some embodiments, the second plate may comprise a bifurcated portion extending towards the distal end portion of the second plate such that a substantially U-shaped or V-shaped space can be formed along a transverse extension of the second plate.

In some embodiments, the first plate may be arranged with respect to the horizontal plane of the support platform at the angle in a range between 17 to 19 degrees. In some embodiments the angle may be 17.8 degrees.

According to various embodiments, the second plate may be arranged at the second angle in a range between 30 to 35 degrees with respect to the first plate. In some embodiments the second angle may be 32 degrees.

In some aspects and embodiments, the first plate may be provided with a spacer element arranged at the front end portion of the first plate. The spacer element may extend along the longitudinal extension of the first plate towards the opening for removing the plurality of playing cards. The spacer element may further be arranged to at least partly extend beneath the distal end portion of the second plate. In some embodiments, two spacer elements may be provided on opposite sides of an axis along the transverse extension of the first plate.

According to some exemplary embodiments, the spacer element may be an integral part of the front end portion of the first plate. The spacer element may have a distal end portion configured to protrude out of a plane of the first surface of the first plate in response to an upward force. The upward force may be exerted by a space-adjustment means. The upward force may be exerted on a second surface of the first plate at the distal end portion of the spacer element, such that the separation between the first plate and the distal end portion of the second plate is changeable. The separation may be changeable based on an amount of protrusion of the distal end portion of the spacer element out of the plane of the first surface of the first plate corresponding to the amount of upward force exerted by the space-adjustment means.

In some exemplary embodiments, the space-adjustment means may comprise a threaded opening, arranged at a distal end portion of a bottom plate of the support platform. The bottom plate may be extending substantially parallel to the horizontal plane of the support platform, such that the threaded opening may be arranged beneath the second surface of the first plate and aligned with the distal end portion of the spacer element. The threaded opening may be configured to receive a screw assembly turnably installed in the threaded opening. The screw assembly comprised in the space-adjustment means may be configured to exert the upward force on the second surface of the first plate at the distal end portion of the spacer element by turning of the screw assembly. Turning the screw assembly in a first direction may cause the distal end portion of the spacer element to protrude out of the plane of the first surface of the first plate, thereby changing the separation between the first plate and the distal end portion of the second plate and adjusting the opening between the first plate and the second plate.

In various exemplary embodiments, the spacer element may be a cut-out contour into the first plate along a cut line extending through an entire thickness of the first plate. A proximal end portion of the spacer element may be fixedly attached to the first plate and the distal end portion of the spacer element may be suspended from the first plate.

By having the spacer element in the form of a cut-out contour into the first plate, manufacturing of the card shoe may be facilitated and the life cycle (longevity) of the card shoe may be improved. In more detail, the cut-out contour alleviates the need for having separate components to provide the adjustable opening between the first plate and the second plate is effectively alleviated, thereby reducing manufacturing complexity and mitigating the risk of erroneous assembly (as there are fewer parts to assemble as compared to prior known solutions).

In several embodiments, the housing may further comprise a metal plate laterally arranged on a first side of the housing at the front end portion of the first plate. The metal plate may partially overlap the first plate and the distal end portion of the second plate. The metal plate may be arranged on either or on both sides of the housing along the lateral extension of the first plate.

According to several aspects and embodiments, the card shoe may further comprise a card-pusher assembly having a bottom surface which may be movably arranged on the first surface of the first plate and inside the receptacle. The card-pusher assembly may comprise a first surface engaging the plurality of playing cards. The first surface may be arranged sloped with reference to the bottom surface of the card-pusher assembly. The card-pusher assembly may further comprise a roller assembly rotationally arranged about an axis of rotation, and configured to move the card-pusher assembly along the longitudinal extension of the elongated body of the housing towards the opening for removing the plurality of playing cards from the receptacle. In some embodiments the card-pusher assembly may further comprise a weight block arranged spaced apart from the roller assembly. The weight block may provide a bias on the plurality of playing cards towards the opening at the front end portion of the first plate. The bias provided by the weight block may be in addition to the bias provided by the card-pusher assembly without the weight block.

In several embodiments, the housing may further comprise a cover lid arrangeable at a top side of the housing and covering the receptacle. An inner surface of the cover lid facing the first surface of the first plate may comprise a protruding fin at least partly extending along the longitudinal extension of the cover lid.

In various aspects and embodiments, the first plate may be made of a material having a friction coefficient allowing the plurality of playing cards to slide continuously on the first plate.

In several exemplary embodiments, an outer surface of the bottom plate of the support platform to be arranged on an external surface may be at least partly covered with a material having a friction coefficient such that a sliding movement of the card shoe arranged on the external surface can be prevented.

It should be appreciated that the materials, angles and geometry of different features of the card shoe according to several aspects and embodiments of the present disclosure are carefully designed to facilitate manufacturing, the card dealing speed, and convenience. Further, the card shoe is designed to have a long life cycle. For instance, the metal plates provided on the sides of housing abutting the opening of the card shoe can prevent premature wear of the card shoe at the front end part of the card shoe.

Also, by making the opening or the gap for card-extraction adjustable by the space-adjustment means, the gap can be adjusted during the life cycle of the card shoe, thus compensating for the natural wear and widening of the gap. The widening of the gap can lead to a problem of extracting more than one playing card at a time by the dealer and thus disrupting the card distribution process during the game play.

The adjustable opening of the presented card shoe, readily allows for the gap to be made narrower and thus the life cycle of the card shoe is prolonged. An additional advantage of the adjustable opening is that, manufacturing tolerances of the playing cards in varying batches and among different card decks can be compensated for. Even further, manufacturing tolerances of the elements and features realizing the opening of the card shoe can also be compensated by fine-tuning the adjustable opening. The adjustable opening has yet another advantage which pertains to calibrating the opening to the varying thicknesses of the playing cards from different card manufacturers which is highly desirable to allow extracting only one card at a time from the card shoe regardless of the manufacturing source of the cards.

This advantage is even more distinct when the card shoe is used in online gaming scenarios, where hundreds of players can be playing simultaneously and thus increasing the dealing speed and certainty of pulling only one card provided by the presented card shoe becomes highly advantageous.

Further embodiments of the invention are defined in the dependent claims. It should be emphasized that the term "comprises/comprising" when used in this specification is taken to specify the presence of stated features, integers, steps, or components. It does not preclude the presence or addition of one or more other features, integers, steps, components, or groups thereof.

These and other features and advantages of the present invention will in the following be further clarified with reference to the embodiments described hereinafter.

BRIEF DESCRIPTION OF THE DRAWINGS

Further objects, features and advantages of embodiments of the invention will appear from the following detailed description, reference being made to the accompanying drawings, in which.

DETAILED DESCRIPTION

Figure 1A:
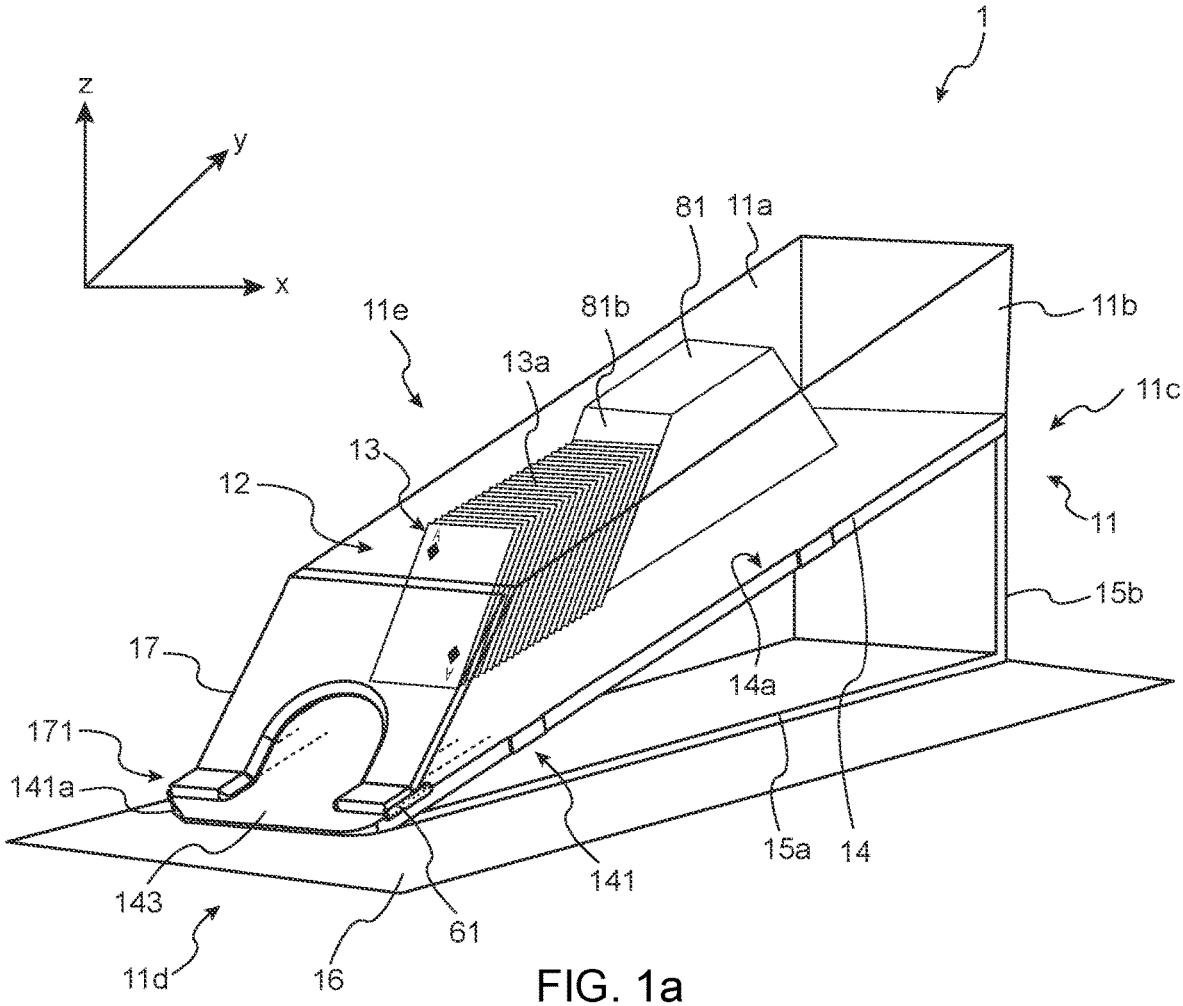
FIG. 1*a* shows a perspective view of a card shoe in accordance with embodiments of the present disclosure.

In the following detailed description, embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well known constructions or functions are not described in detail, so as not to obscure the present invention.

The following description will use terms such as "top", "bottom", "inner", "outer", "side", "edge", "ridge", "distal", "proximal", "front", "back" etc. These terms generally refer to the views and orientations as shown in the drawings. The terms are used for the reader's convenience only and shall not be construed as limiting.

In the context of the present invention the directions and orientations such as vertical, horizontal, longitudinal, and lateral directions and extensions need to be interpreted broadly and generally refer to the geometrical extensions of objects in a coordinate system such as a three-dimensional Cartesian coordinate system. The spatial extensions and positions of objects e.g. the orientation of the first plate, or the second plate or a spatial relation thereof can therefore be defined in at least one plane of the coordinate system e.g. by using x, y, z coordinates and their corresponding angles.

In essence, the vertical direction or the z-direction is orthogonal or perpendicular to the horizontal reference plane of the support platform. The longitudinal direction or y-direction is parallel to the horizontal reference plane of the support platform. The lateral or transverse direction (the x-direction) is orthogonal to both the y-direction and the z-directions.

The longitudinal extension of an element e.g. the longitudinal extension of the first plate or the elongated body may be interpreted as the direction coinciding with the longest extension of the first plate or the elongated body. Lateral or transverse extension of an element e.g. a transverse extension of the second plate may be interpreted as the direction coinciding with the extension being substantially transverse the longitudinal extension of the element.

Figure 2:
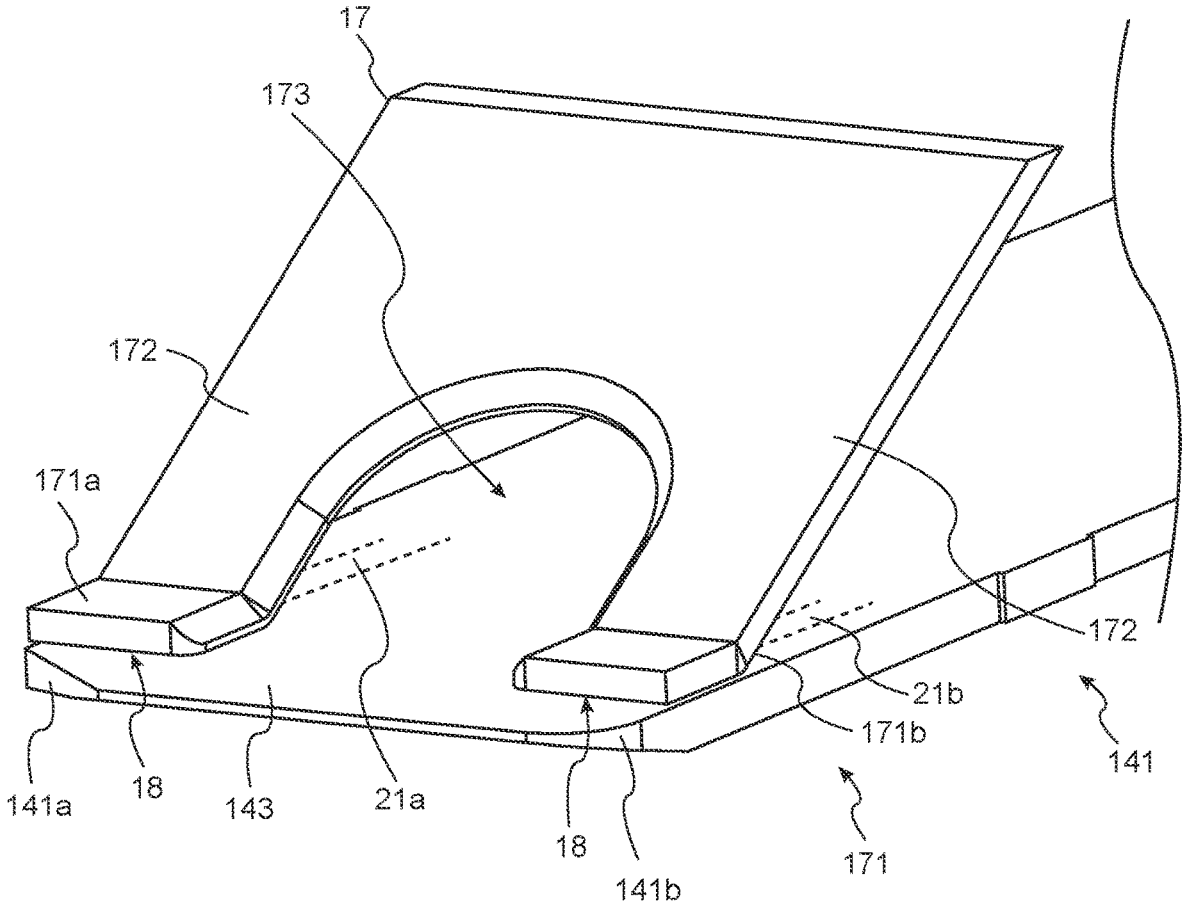
FIG. 2 shows a perspective view of a front end portion of the card shoe in accordance with embodiments of the present disclosure.
Figure 3:
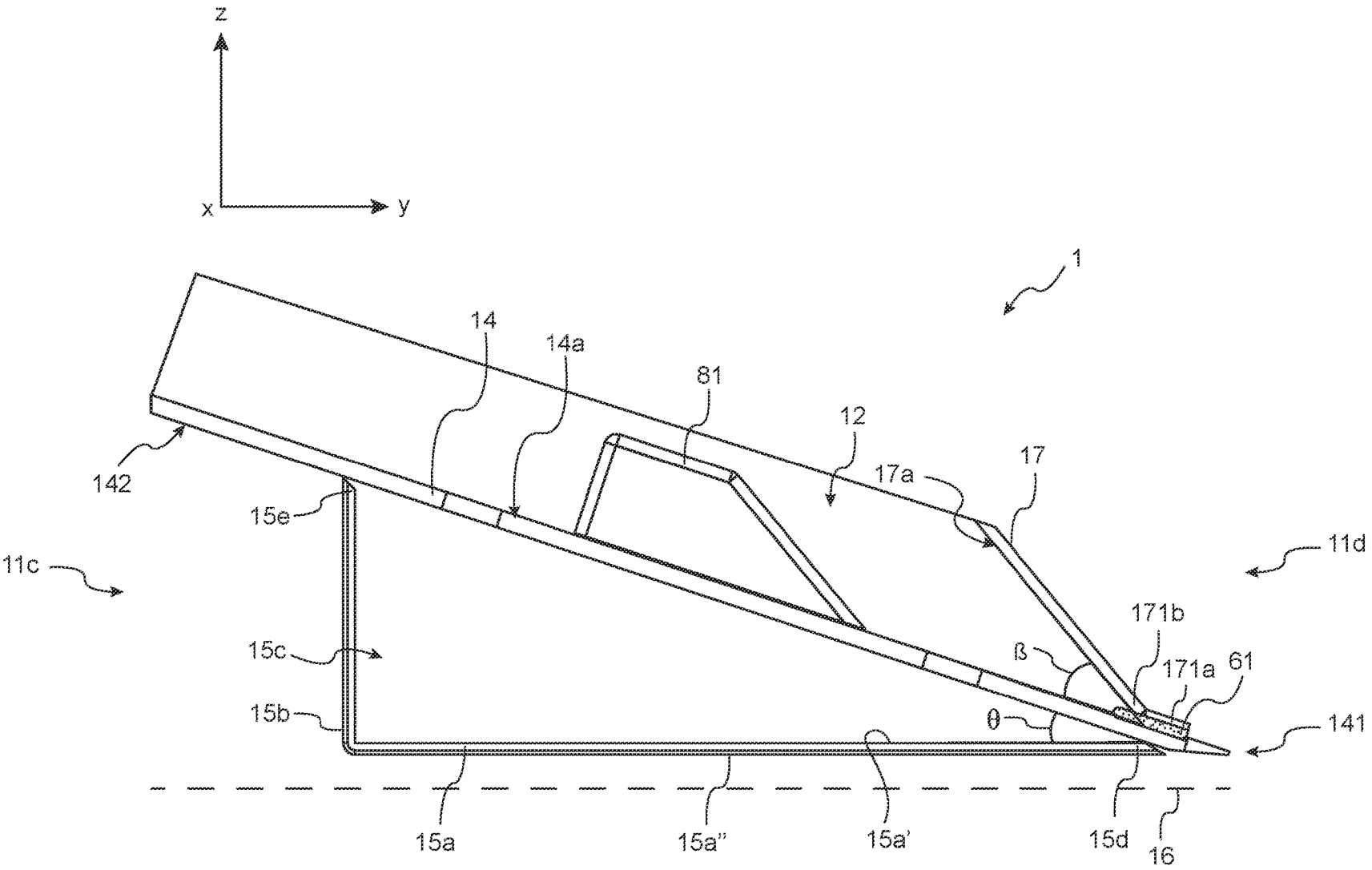
FIG. 3 shows a side view of the card shoe and different angles of elements of the card shoe in accordance with embodiments of the present disclosure.

FIG. 1 shows a schematic perspective view of a card shoe 1 according to various embodiments. A corresponding schematic side view of the card shoe is also illustrated in FIG. 3. The card shoe 1 comprises a housing 11 having an elongated body which comprises a receptacle 12 for receiving a plurality of playing cards 13. The housing 11 further comprises a first plate 14 arranged on a support platform 15 at a first angle "θ" with respect to a horizontal reference plane 16 of the support platform 15 as depicted in the schematic side view of the card shoe in FIG. 3. The first plate 14 has a first surface 14*a* for supporting the plurality of playing cards 13. Stated differently, the playing cards 13, when inserted inside the receptacle 12, are arranged to rest on the first surface 14*a* i.e. the top surface 14*a* of the first plate 14. The receptacle 12 is formed by arranging the first plate 14, sometimes referred to as the base plate of the card shoe 1, adjacent to a first side wall 11*a* and a second side wall 11*b* partly forming the housing 11 of the card shoe. The base plate 14, is arranged to abut the support platform 15 at a front part 15*d* and at a back part 15*e* of the support platform 15. A front end portion 141 of the first plate 14 may be arranged to abut a bottom plate 15*a* of the support platform 15 at the front part 15*d* and a rear end portion 142 of the first plate 14 may abut a vertical or standing plate 15*b* of the support platform 15 at the back part 15*e*. The base plate 14, may also abut the first and the second side walls 11*a*, 11*b*. The base plate 14 may be fixedly or removably attached to the support platform 15 and/or the side walls 11*a*, 11*b*. The first plate is sloped downwards from the back 11*c* of the elongated body of the housing to the front 11*d* of the elongate body of the housing. This placement and orientation of the first plate 14 facilitates a sliding motion of the playing cards 13 toward the front 11*d* of the housing. The housing 11 further comprises a second plate 17 arranged adjacent to the front end portion 141 of the first plate 14 at a second angle "β" with respect to the first plate 14. Further, the second plate 17 comprises a distal end portion 171 arranged spaced apart from the first plate 14 as shown in FIG. 2. The second plate 17, is also arranged to form part of the receptacle 12 at the front end 11*d* of the elongated body of the housing 11. The second plate 17 is not necessarily attached to the first plate 14, but may be attached to and supported by the side walls 11*a*, 11*b* of the housing 11. With the above arrangement an opening 18, sometimes referred to as a card-extraction opening, for removing the plurality of playing cards from the receptacle 12 is formed at the front end portion 141 of the first plate 14 between the first surface 14*a* of the first plate and a first surface 17*a* of the distal end portion 171 of the second plate facing the first surface of the first plate. In various embodiments, the first plate 14 is configured such that the card-extraction opening 18 between the first plate 14 and the second plate 17 is adjustable by changing a separation or a gap G1, G2 between the first plate 14 and the distal end portion 171 of the second plate 17. This way, the plurality of the playing cards 13, can be guided towards the card-extraction opening 18 between the first plate 14 and the second plate 17 where they can be pulled by the dealer one by one. Accordingly, the inventors have realized that manufacturing tolerances, or unpredictable minor asymmetries of the dimensions amongst the cards, or even natural wearing of the playing cards after manufacturing e.g. due to repeated use, may affect the speed of extraction, pull force needed to extract the cards and consequently the overall quality of the game play.

In particular, not all cards in a particular batch of manufactured card decks may have exactly the same thickness, and such tolerances in the card thickness may vary to a degree which cannot be negligible. Further, the inventors have realized that similar tolerances may occur in the manufacturing process of the card shoes and specifically the separation or gap G1, G2 between the surfaces leading towards and forming the opening 18 for card extraction may vary among the manufactured card shoes. The inventors have further realized that the gap G1, G2 might become wider due to repeated use of the card shoe and wearing of the material. Thus more than one playing card may be extracted from the opening.

Accordingly, the inventors have realized and propose that adjustably changing the separation between the first plate 14 and the second plate 17 provides that at any single instance of pulling a playing card out of the opening 18, one and only one playing card 13, is extracted under a controlled pull motion by the dealer. This way no clogging or stopping of the extraction motion at the opening 18 occurs due to multiple cards e.g. two playing cards being forced into the card-extraction opening 18 due to the discrepancy between the thickness of each playing card and the width of the gap G1, G2 i.e. the separation between the first 14 and the second plate 17. Consequently, the speed of extraction of cards from the card shoe is noticeably increased, and the extraction motion is controllably regulated such that the dealer uses a harmonized force to pull each playing card out of the card shoe. Further, problems such as fatigue imposed on the dealer due to design issues of the card shoe is alleviated and also the overall quality of the game play is elevated for the players since the process of dealing playing cards and placing bets would be seamless even for an online game play scenario.

FIG. 2 illustrates a perspective front view of the housing comprising the front end portion 141 of the first plate 14 and the distal end portion 171 of the second plate 17 arranged spaced apart from the first plate 14. In some embodiments and aspects, for instance as shown in FIG. 2, the first plate 14 may comprise a protruding ridge 143 at the front end portion 141 of the first plate 14, extending outward from the opening 18 between the first plate and the second plate, wherein the ridge 143 comprises at least one corner portion 141*a* slanted at an angle with respect to the longitudinal extension of the first plate. The slanted corner 141*a* of the front end portion 141 of the first plate 14, may be either one or both corners of the front end portion 141. The slanted corner has a slanting angle which is less than 90 degrees. The angle can for instance be 30, 45, or 60 degrees. In some embodiments, one corner may be a slanted corner 141*a* and the other corner may be a rounded corner 141*b* with the right angle i.e. 90 degrees. An advantage of having a slanted corner is that contrary to conventional card shoes having corners at a right angle, the present card shoe provides the slanted corner, which is usually closer to the dealer, so that the dealer can easily push the playing cards on dealer's thumb and pick the card off the surface of the ridge 143 after extraction. This way the dealer can perform the card distribution more rapidly and conveniently.

In some embodiments and aspects, the second plate of the card shoe may comprise a bifurcated portion 172 extending towards the distal end portion 171 of the second plate 17 such that a substantially U-shaped or V-shaped space 173 is formed along a transverse extension i.e. the lateral extension of the second plate. In FIG. 2, this space 173 is illustrated as an inverted U-shaped space 173. In the embodiment of FIG. 2, the bifurcated portion 172 of the second plate is arranged to slope downwardly towards the distal end portion 171 of the second plate 17 which is arranged adjacent and spaced apart from the first plate. The distal end portion 171 has a flat end part 171*a* extending substantially parallel with the first plate 14 of the card shoe 1. The distal end portion 171 in some embodiments however, may not comprise the flat end part 171*a* parallel to the first plate 14 but rather be arranged adjacent and spaced apart from the base plate 14 at an sloped end part 171*b*.

Referring to FIG. 3, the sloped end part 171*b* of the distal end portion 171 of the second plate 17 may be arranged at the second angle "β" in a range between 30 to 35 degrees with respect to the first plate. In some embodiments, the angle "β" may be 32 degrees.

Also as shown in FIG. 3, the first plate 14 in several embodiments may be arranged with respect to the horizontal reference plane 16 of the support platform 15 at the first angle "θ" in a range between 17 to 19 degrees. In some embodiments first angle "θ" may be 17.8 degrees.

Figure 4A:
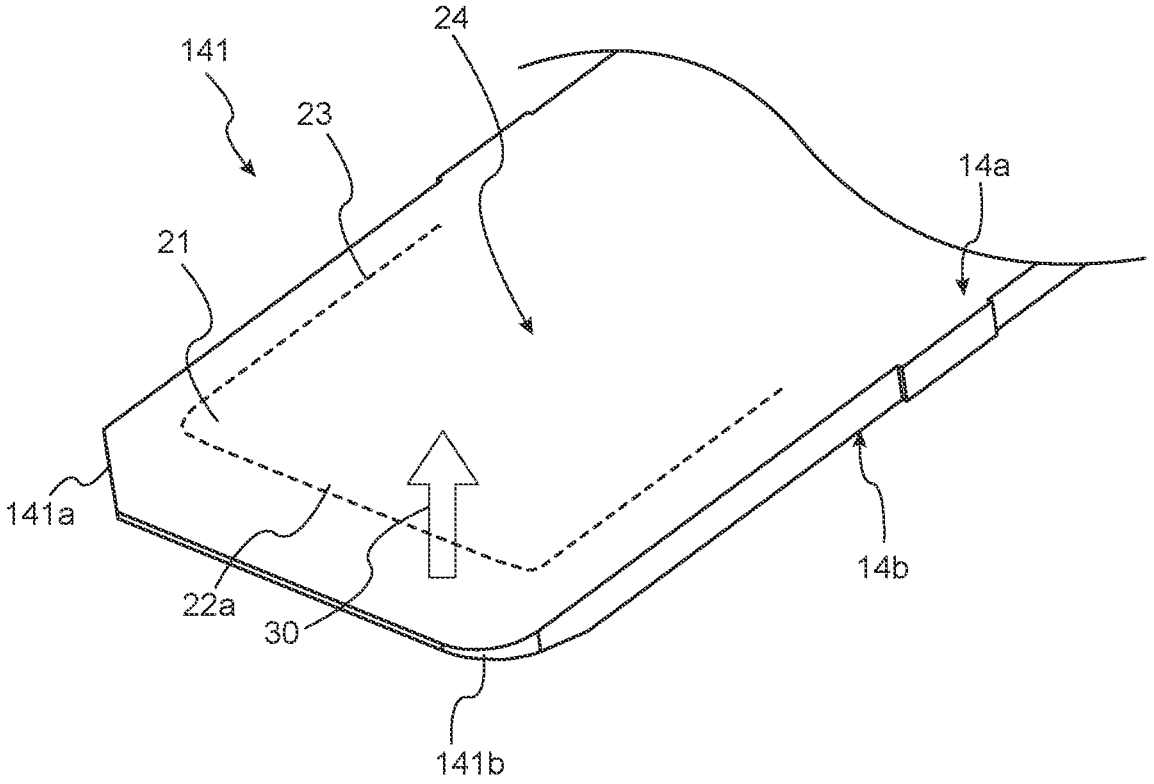
FIGS. 4*a-b* show a perspective view of a front end portion of a first plate of the card shoe in accordance with embodiments of the present disclosure.
Figure 4B:
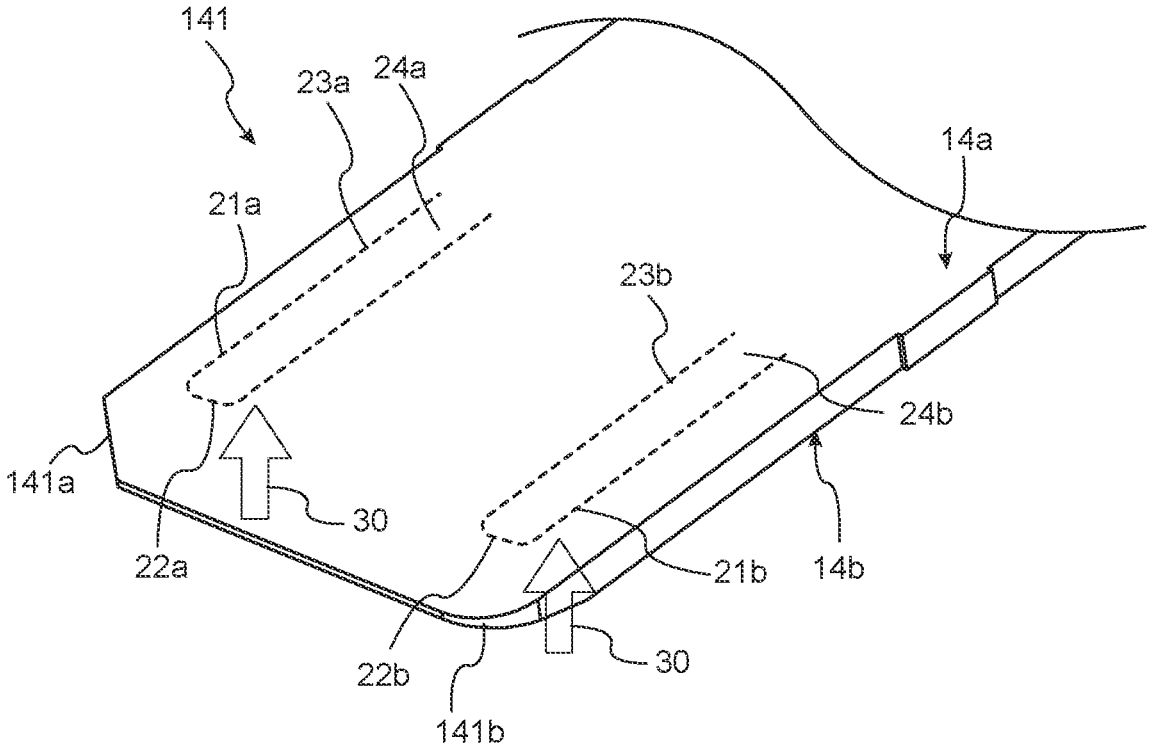

In several embodiments and examples, the first plate 14 may be provided with a spacer element 21, 21*a*, 21*b* as shown in the perspective top views of the front end portion 141 of the first plate 14 in FIGS. 4*a-b*. The spacer element in the embodiments of FIGS. 4*a-b* has an elongated U-shape; either being a single U-shaped element 21, extending laterally over a main part of the transverse extension of the front end portion 141 of the first plate 14 as in FIG. 4*a* or comprising two narrower U-shaped spacer elements 21*a*, 21*b* as illustrated in FIG. 4*b*. It is however clearly understood by the skilled person that the spacer elements need not have an elongated U-shaped or tongue-like appearance and may be fabricated in various shapes and geometries such as rectangular, triangular, circular, square, etc. suitable to impose an external force on the spacer elements as will be explained further in detail.

The spacer elements are arranged at the front end portion 141 of the first plate 14 and extend along the longitudinal extension of the first plate towards the opening 18 for removing the plurality of playing cards 13. In several embodiments as shown on FIGS. 4*a-b* and FIGS. 5*a-e*, the spacer elements 21, 21*a*, 21*b* are an integral part of the front end portion 141 of the first plate. By integral in the present context it is meant that the spacer element is not an external element juxtaposed with the front end portion 141 of the first plate 14. But rather, the spacer element forms a part of the body of the first plate 14. In some embodiments, such an integral part is manufactured by cutting the shape of the spacer element into the body of the first plate 14 at its front end portion 141 (e.g. by means of laser cutting). For instance, the spacer element 21, 21*a*, 21*b*, may be a cut-out contour into the first plate along a cut line 23, 23*a*, 23*b* extending through an entire thickness of the first plate as shown in FIGS. 5*d-e*. In these embodiments, a proximal end portion 24, 24*a*, 24*b* of the spacer element 21, 21*a*, 21*b* is fixedly attached to the first plate 14 and the distal end portion 22, 22*a*, 22*b* of the spacer element 21, 21*a*, 21*b* is suspended from the first plate. In other words, the spacer elements is arranged to have a springboard or cantilever profile supported at only one end i.e. the proximal end portion 24, 24*a*, 24*b*. Thus, when the cantilever is subjected to a structural load i.e. an upward force 30 at its distal end portion 22, 22*a*, 22*b*, the force is carried through the spacer element to its proximal end portion, therefore creating a bending motion at the distal end portion 22, 22*a*, 22*b* of the spacer element 21, 21*a*, 21*b*. This bending motion causes the distal end portion 22, 22*a*, 22*b* i.e. the suspended portion to protrude in the direction of the applied force i.e. the z direction.

In other words, the distal end portion 22, 22*a*, 22*b* is configured to protrude out of a plane of the first surface 14*a* of the first plate. The upward force 30 may be exerted, by a space-adjustment means (e.g. screws with corresponding threaded openings in the bottom plate 15*a*), on a second surface 14*b* of the first plate 14 at the distal end portion 22, 22*a*, 22*b* of the spacer element 21, 21*a*, 21*b*. The upward force in FIG. 4*a-b* is shown as an upward-pointing arrow 30 indicating that the force 30 will push the distal end portion 22, 22*a*, 22*b* of the spacer element 21, 21*a*, 21*b* upwards in the vertical i.e. z direction, such that the distal end portion 22, 22*a*, 22*b* protrudes out of the plane of the first surface 14*a* of the first plate towards the first surface 17*a* of the distal end portion 171 of the second plate 17. This way, the separation between the first plate 14 and the distal end portion 171 of the second plate 17 is changeable based on an amount of protrusion of the distal end portion 22, 22*a*, 22*b* of the spacer element 21, 21*a*, 21*b* out of the plane of the first surface of the first plate as shown in FIGS. 5*d-e*. It also logically follows that when the amount of the upward force 30 is decreased, the distal end portion 22, 22*a*, 22*b* is correspondingly retracted from its protruded state. For instance, as shown in FIGS. 5*d-e*, when the distal end portion 22, 22*a*, 22*b* is at its fully settled state i.e. no upwards force is applied, then it has an elevation of Z0 in the z direction. In this state, the maximum separation or gap between the first plate 14 and the second plate 17 is G1. In several embodiments, G1 may be in a range between 0 to 1 mm. in some embodiments G1 may be 0.55 mm. However, when the upwards force F1 is applied to the distal end portion 22, 22*a*, 22*b*, it bends upward towards the first surface 17*a* of the distal end portion 171 of the second plate and assumes an elevation of Z1 in the vertical direction. At the elevated state Z1, the gap between the first surface 14*a* of the first plate and the first surface 17*a* of the second plate 17 is G2. When the amount of force 30 is decreased i.e. a downward force vector component is introduced, the distal end portion 22, 22*a*, 22*b* correspondingly reverts back towards its fully settled state Z0.

By having the spacer element 21, 21*a*, 21*b* in the form of a cut-out contour into the first plate 14, the manufacturing of the card shoe may be facilitated and the life cycle (longevity) of the card shoe may be improved. In more detail, the cut-out contour alleviates the need for having separate components to provide the adjustable opening G1, G2 between the first plate 14 and the second plate 17 is effectively alleviated, thereby reducing manufacturing complexity and mitigating the risk of erroneous assembly (as there are fewer parts to assemble as compared to prior known solutions).

Figure 5A:
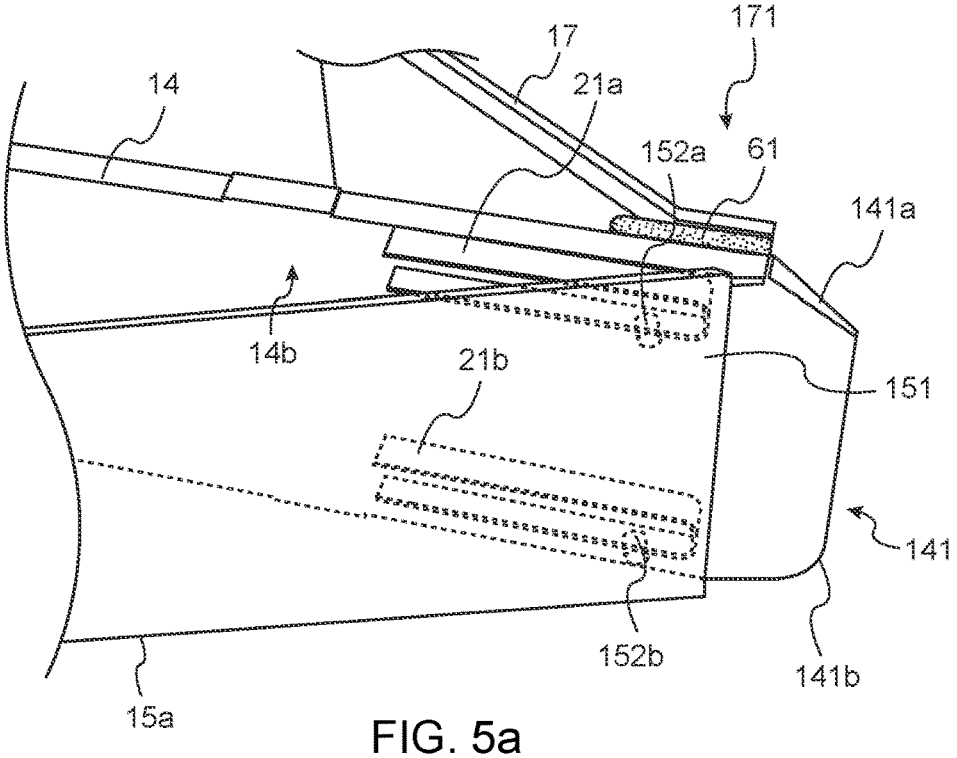
FIGS. 5*a-e* show various views of the front end of the card shoe comprising spacer elements in accordance with several embodiments of the present disclosure.

As shown in FIG. 5*a*, the spacer element 21, 21*a*, 21*b*, may in several embodiments be arranged to at least partly extend beneath the distal end portion 171 of the second plate. In several embodiments, the spacer element and in particular the distal end portion 22, 22*a*, 22*b* of the spacer element is arranged to either extend partly under the flat end part 171*a* and/or the sloped end part 171*b* of the distal end portion 171 of the second plate 17.

Figure 5B:
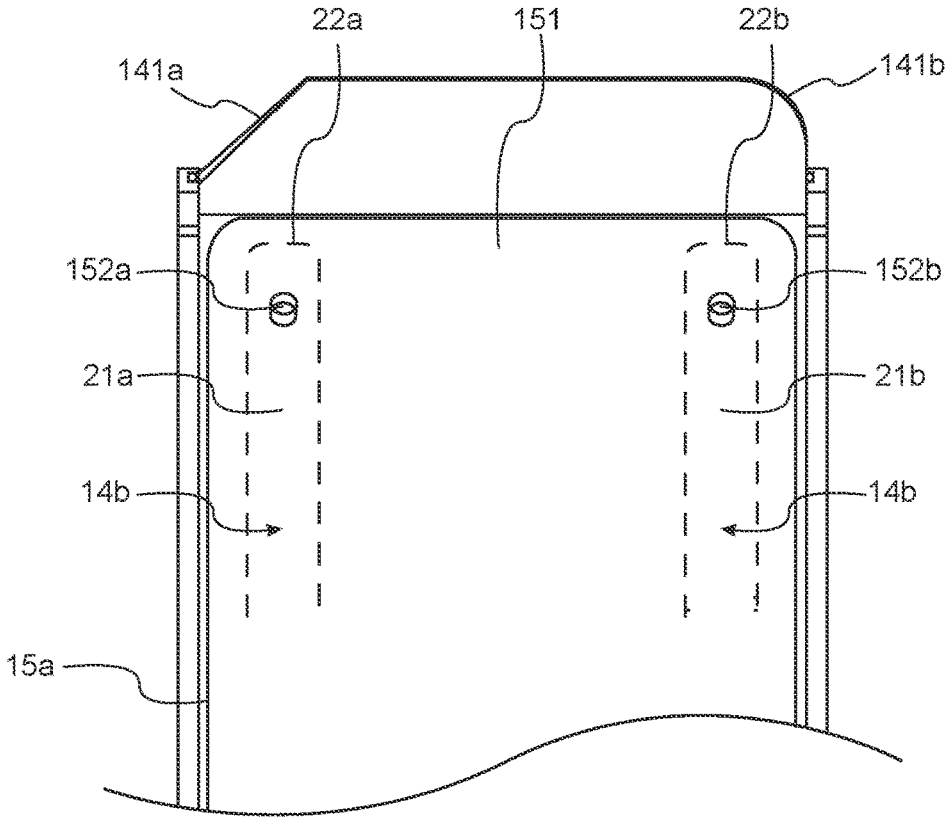
Figure 5C:
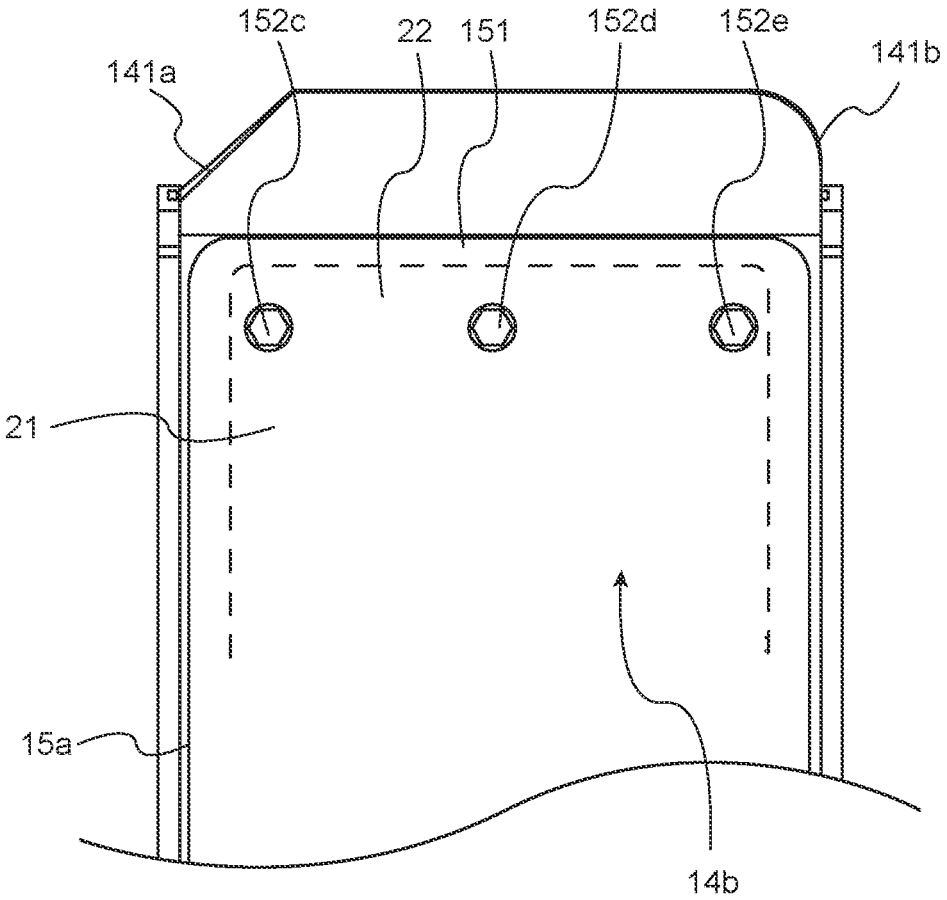
Figure 5D:
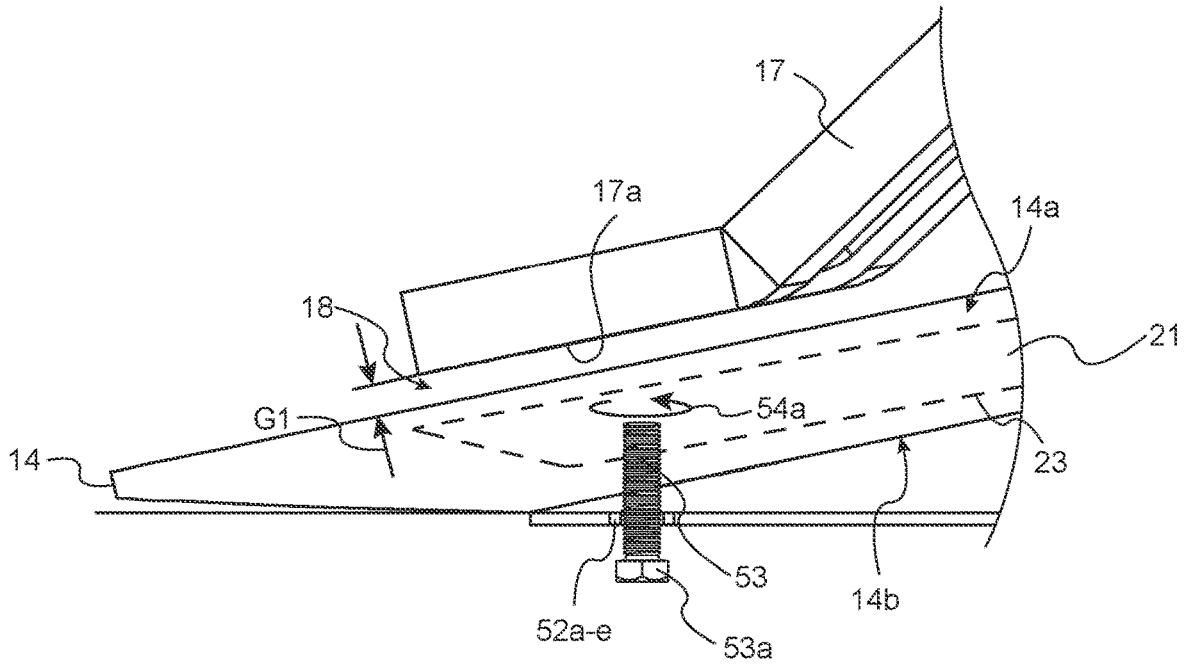
Figure 5E:
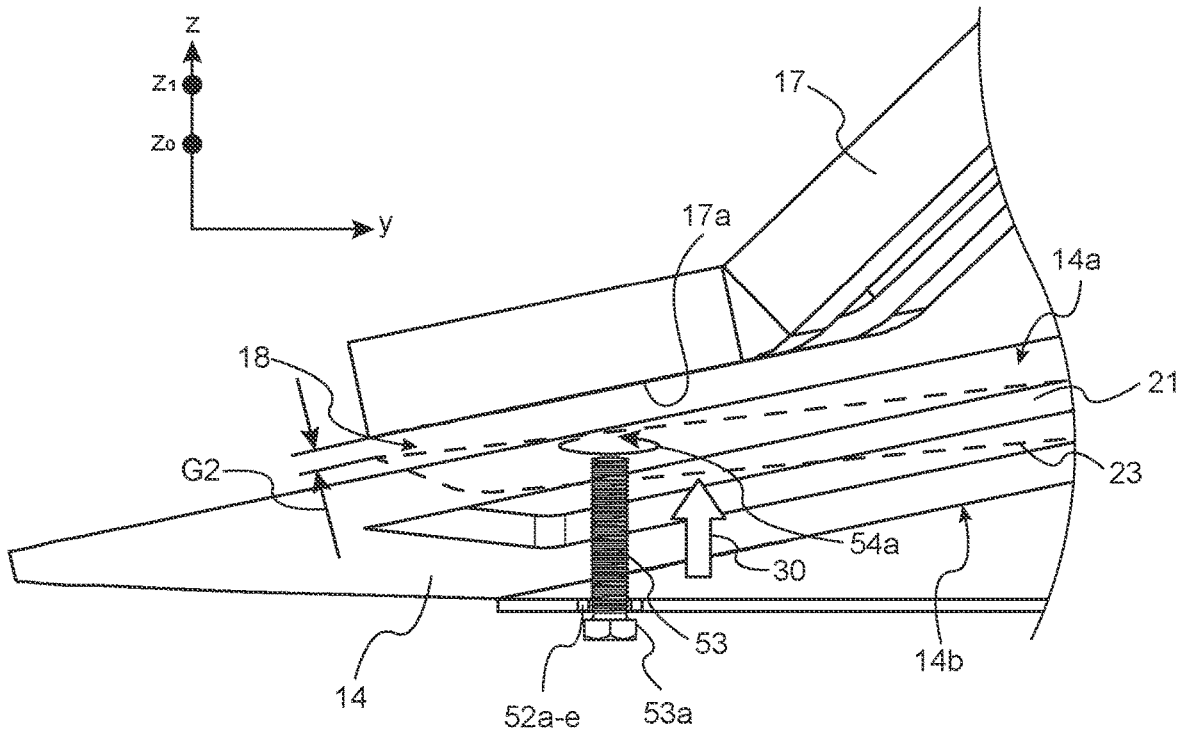

In several embodiments and aspects, the space-adjustment means of the card shoe 1 may comprise a threaded opening 152*a-e* arranged at a distal end portion 151 of the bottom plate 15*a* of the support platform 15, as shown in FIGS. 5*a-e*. Wherein the bottom plate 15*a* is arranged to extend substantially parallel to the horizontal reference plane 16 of the support platform 15. FIG. 5*a* shows that the threaded openings 152*a-e* may be arranged beneath the second surface 14*b* of the first plate 14 and aligned with the distal end portion 22, 22*a*, 22*b* of the spacer element 21, 21*a*, 21*b*. As shown in FIG. 5*b*, each spacer element may have a single threaded opening aligned therewith. For example the spacer elements 21*a* and 21*b* each have a single threaded opening 152*a* and 152*b* aligned with and arranged under their respective distal end portions 22*a*, 22*b*. In some embodiments however, a plurality of threaded openings 152*c-e* may be arranged under the distal end portion of the spacer element as shown in FIG. 5*c* for the spacer element 21. In several embodiments, the threaded openings 52*a-e* are configured to receive a screw assembly 53 turnably installed in the threaded openings. The screw assembly 53 is configured to provide the space-adjustment mechanism by exerting the upward force 30 on the second surface 14*b* of the first plate 14 at the distal end portion 22, 22*a*, 22*b* of the spacer element 21, 21*a*, 21*b* by turning of the screw assembly. Accordingly, the turning of the screw assembly 53 in a first direction 54*a* i.e. clockwise direction causes the distal end portion 22, 22*a*, 22*b* of the spacer element to protrude out of the plane of the first surface of the first plate, thereby changing the separation G1, G2 between the first plate 14 and the distal end portion 171 of the second plate. Naturally, the "first direction" will depend on the desired configuration of the threads and chosen assembly of the card shoe, thus the "first direction" may also be anti-clockwise in some embodiments. In other words, the part 53*a* of the screw assembly 53 that abuts the spacer element will push the distal end portion 22, 22*a*, 22*b* of the spacer element upwards and toward the first surface 17*a* of the distal end portion 171 of the second plate 17, thus adjusting the opening 18 between the first plate and the second plate. In some embodiments and aspects, the screw assembly 53 may be accessible by the dealer from the side of the housing 11 through a space 15*c* formed between the bottom plate 15*a* and the vertical plate 15*b* of the support platform 15. In some embodiments e.g. when such a space 15*c* may be covered by side walls of the housing 11, the screw assembly may be reached by the dealer from under the bottom plate 15*a* of the support platform 15. In some embodiments and aspects, the screw-assembly 53 may be mounted on an external insert block (not shown) arranged e.g. on a first surface e.g. an inner surface 15*a*' of the bottom plate 15*a*. In some embodiments, the screw assembly may be provided with a rotary knob (not shown) affixed to the screw assembly so as to make it easier for the dealer to fine tune the separation G1, G2 between the first plate and the second plate.

Figure 6:
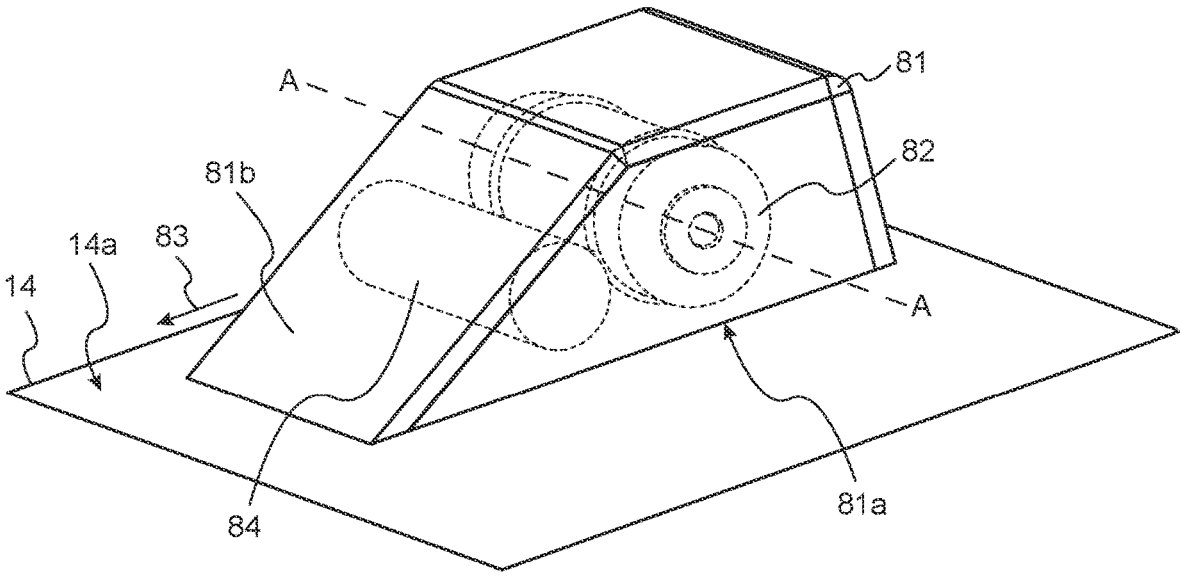
FIG. 6 shows a perspective view of a card-pusher assembly in accordance with embodiments of the present disclosure.

In several aspects and embodiments, the card shoe 1 may further comprise a card-pusher assembly 81 having a bottom surface 81*a* movably arranged on the first surface 14*a* of the first plate and inside the receptacle 12 as shown in FIG. 1, and in more detail in FIG. 6. The card-pusher assembly 81 comprises a first surface 81*b* engaging the plurality of playing cards 13, wherein the first surface 81*b* is arranged sloped with reference to the bottom surface 81*a* of the card-pusher assembly 81. The plurality of playing cards are thus positioned in the receptacle with one side resting on the first plate 14, one side leaning on the first surface 81*b* of the card pusher assembly 81, one side in contact with a cover lid 91 of the housing 11 and one side facing the front end 11*d* of the elongated body toward the opening 18. In several embodiments, the card-pusher assembly 81 may further comprise a roller assembly 82 rotationally arranged about an axis of rotation "A-A". The roller assembly is configured to move the card-pusher assembly along the longitudinal extension of the elongated body of the housing 11 in the direction of the arrow 83 and towards the opening 18 for biasing the plurality of playing cards against the second plate 17 and the opening 18. In several embodiments, the card-pusher assembly 81 may further comprise a weight block 84 arranged spaced apart from the roller assembly 82 (either placed in front of the roller assembly 82 as shown in FIG. 6 or in some embodiments behind the roller assembly 82. In some embodiments more than one weight block 84, e.g. two weight blocks may be provided (not shown). For instance, one weight block may be arranged behind and one weight block in front of the roller assembly 82. Thereby, the weight block(s) 84 are configured for providing an additional bias on the plurality of playing cards 13 towards the opening 18. By providing a constant bias on the playing cards toward the front end 11*d* of the elongated body of the housing 11, the weight block 84 provides an additional advantage of providing a resisting force against a playing card which may be prone to be pushed back into the receptacle 12 via the opening 18 after being pulled out by the dealer.

In several aspects and embodiments, different components of the card shoe e.g. the first plate, the second plate, the support platform, the card-pusher etc. may at least partly be constructed out of any rigid materials such as glass, wood or different varieties of plastic such as thermoplastics, polymethyl methacrylate (PMMA), or brands such as Plexiglass.

In various embodiments, the first plate 14 may be made of a material having a friction coefficient allowing the plurality of playing cards to slide continuously on the first plate. The material may for example be frost Plexiglass which has a lower friction coefficient than the transparent Plexiglass.

In some aspects and embodiments, the housing 1 may further comprise a metal plate 61 laterally arranged on a first side 11*a*, 11*b* of the housing 11 as shown in FIG. 1. The first side here could be construed as a side of the housing 11 coinciding with the first side wall 11*a*, and/or the second side wall 11*b* of the housing 11. The metal plate thus may be arranged in either or both sides of the housing 11 coinciding with the side walls 11*a* and 11*b*. The metal plates 61 may be an external metal plate arranged at the front end portion 141 of the first plate 14. The metal plate 61 may be arranged to partially overlap the first plate 14 and the distal end portion 171 of the second plate 17. In some embodiments, the metal plate may be an integral metalized part (not shown) of the side walls 11*a*, 11*b* of the housing 11 coinciding the front end portion of the first plate. When the playing cards are being pulled out of the receptacle 12 via the card-extraction opening 18, each side edge of each playing card will have a contacting point with one of the metal plates 16. An advantage of providing the card shoe with the metal plates or metalized parts on the side walls, is that the card shoe will be more durable against the natural wear due to pulling cards. In the card shoe of the present disclosure, the cards will touch the metal plates when being pulled out and damages such as friction-inflicted damages on the plastic components at the front end lid of the card shoe 1 as well as in the surroundings of the card-extraction opening 18 can be considerably minimized.

Moving on, in several embodiments an outer surface 15*a*" surface of the bottom plate 15*a* of the support platform 15 is adapted to be arranged on an external surface e.g. a card game playing table (not shown). The outer surface 15*a*" may at least partly be covered with a material having a friction coefficient such that a sliding movement of the card shoe arranged on the external surface is prevented. The outer surface 15*a*" may be covered with rubber or patterned rubber or textile such as felt which will reduce or completely prevent the sliding of the card shoe on the external surface of the playing table. This way accidental movements of the card shoe during the game play, which may interrupt the process of dealing cards to the players, can be easily prevented.

Figure 1B:
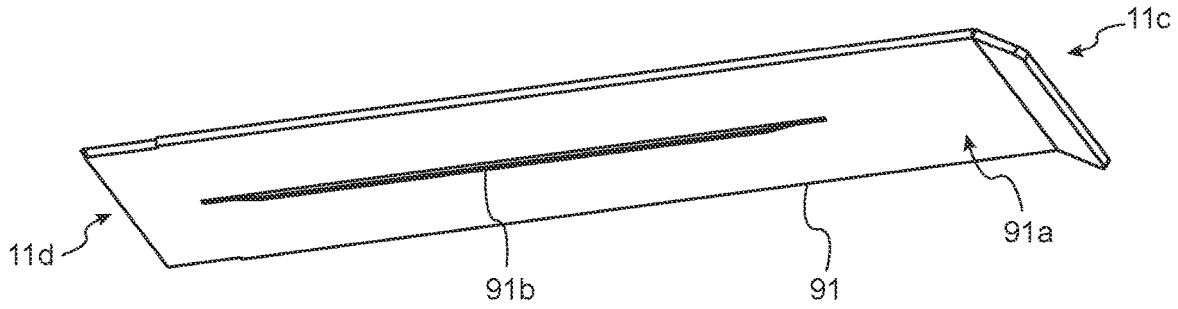
FIG. 1*b* shows a perspective view of a cover lid for the card shoe in accordance with embodiments of the present disclosure.

In some embodiments and aspects, the housing 11 may further comprise the cover lid 91 as shown in FIG. 1*b* arrangeable at a top side 11*e* of the housing 11. The cover lid 91 is arranged to cover the receptacle when being removably placed on the housing 11, thus concealing the playing cards. In several embodiments an inner surface 91*a* of the cover lid 91 facing the first surface of the first plate may comprise a protruding fin 91*b* at least partly extending along the longitudinal extension of the cover lid. In some embodiments the fin 91*b* may extend over the entire length of the cover lid 91. When being removably placed on the receptacle 12, the cover lid 91 closes off the receptacle 12 and the protruding fin 91*b* is brought in contact with a top side 13*a* of the plurality of the playing cards 13. This way the fin imposes a downward constraint on the playing cards 13 such that the cards are kept well organized within the confined space of the receptacle and move steadily and evenly towards the opening 18 during the game play. Another advantage is that, by using the fin 91*b*, the friction of the cover lid i.e. the inner surface 91*a* of the cover lid against the playing cards is minimized since the only part of the inner surface 91*a* of the cover lid in physical contact with the playing cards will be the fin 91*b*. The cover lid 91 may also be made of the same materials as the housing such as plastic or glass.

The invention has now been described with reference to specific embodiments. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements.

The invention claimed is:

1. A card shoe comprising:

a housing having an elongated body and comprising a receptacle for receiving a plurality of playing cards, wherein the housing further comprises a first plate arranged on a support platform at a first angle with respect to a horizontal reference plane of the support platform, the first plate having a first surface for supporting the plurality of playing cards, the housing further comprising a second plate arranged adjacent to a front end portion of the first plate at a second angle with respect to the first plate, and comprising a distal end portion arranged spaced apart from the first plate, such that an opening for removing the plurality of playing cards from the receptacle is formed at the front end portion of the first plate between the first surface of the first plate and a first surface of the distal end portion of the second plate facing the first surface of the first plate, wherein the first plate is configured such that the opening between the first plate and the second plate is adjustable by changing a separation between the first plate and the distal end portion of the second plate, wherein the first plate is provided with a spacer element arranged at the front end portion of the first plate and extending along a longitudinal extension of the first plate towards the opening for removing the plurality of playing cards, wherein the spacer element is further arranged to at least partly extend beneath the distal end portion of the second plate, wherein the spacer element is an integral part of the front end portion of the first plate and has a distal end portion configured to protrude out of a plane of the first surface of the first plate in response to an upward force exerted, by a screw assembly, on a second surface of the first plate at the distal end portion of the spacer element, such that the separation between the first plate and the distal end portion of the second plate is changeable based on an amount of protrusion of the distal end portion of the spacer element out of the plane of the first surface of the first plate.

2. The card shoe according to claim 1, wherein the second plate comprises a bifurcated portion extending towards the distal end portion of the second plate such that a substantially U-shaped or V-shaped space is formed along a transverse extension of the second plate.

3. The card shoe according to claim 1, wherein the first plate is arranged with respect to the horizontal plane of the support platform at the first angle in a range between 17 to 19 degrees.

4. The card shoe according to claim 1, wherein the second plate is arranged at the second angle in a range between 30 to 35 degrees with respect to the first plate.

5. The card shoe according to claim 1, further comprising a threaded opening, arranged at a distal end portion of a bottom plate of the support platform, the bottom plate extending substantially parallel to the horizontal plane of the support platform, such that the threaded opening is arranged beneath a second surface of the first plate and aligned with the distal end portion of the spacer element, and is configured to receive a screw assembly turnably installed in the threaded opening, the screw assembly being configured to exert an upward force on the second surface of the first plate at the distal end portion of the spacer element by turning of the screw assembly, wherein the turning of the screw assembly in a first direction causes the distal end portion of the spacer element to protrude out of the plane of the first surface of the first plate, thereby changing the separation between the first plate and the distal end portion of the second plate and adjusting the opening between the first plate and the second plate.

6. The card shoe according to claim 1, wherein the spacer element is a cut-out contour into the first plate along a cut line extending through an entire thickness of the first plate, such that a proximal end portion of the spacer element is fixedly attached to the first plate and the distal end portion of the spacer element is suspended from the first plate.

7. The card shoe according to claim 1, wherein the housing further comprises a metal plate laterally arranged on a first side of the housing at the front end portion of the first plate and partially overlapping the first plate and the distal end portion of the second plate.

8. The card shoe according to claim 1, wherein the card shoe further comprises:

a card-pusher assembly having a bottom surface movably arranged on the first surface of the first plate and inside the receptacle, the card-pusher assembly comprising a first surface engaging the plurality of playing cards, the first surface arranged sloped with reference to the bottom surface of the card-pusher assembly, the card-pusher assembly further comprising a roller assembly rotationally arranged about an axis of rotation, and configured to move the card-pusher assembly along a longitudinal extension of the elongated body of the housing towards the opening for removing the plurality of playing cards from the receptacle, wherein the card-pusher assembly further comprises a weight block arranged spaced apart from the roller assembly whereby providing a bias on the plurality of playing cards towards the opening at the front end portion of the first plate.

9. The card shoe according to claim 1, wherein the housing further comprises a cover lid arrangeable at a top side of the housing and covering the receptacle, wherein an inner surface of the cover lid facing the first surface of the first plate comprises a protruding fin at least partly extending along a longitudinal extension of the cover lid.

10. The card shoe according to claim 1, wherein the first plate comprises a protruding ridge at the front end portion of the first plate, extending outward from the opening between the first plate and the second plate, and wherein the ridge comprises at least one corner portion slanted at an angle with respect to a longitudinal extension of the first plate.

11. The card shoe according to claim 1, wherein the first plate is made of a material having a friction coefficient allowing the plurality of playing cards to slide continuously on the first plate.

12. The card shoe according to claim 1, wherein an outer surface of a bottom plate of the support platform to be arranged on an external surface is at least partly covered with a material having a friction coefficient such that a sliding movement of the card shoe arranged on the external surface is prevented.

13. A card shoe comprising:

a housing having an elongated body and comprising a receptacle for receiving a plurality of playing cards, wherein the housing further comprises a first plate arranged on a support platform at a first angle with respect to a horizontal reference plane of the support platform, the first plate having a first surface for supporting the plurality of playing cards, the housing further comprising a second plate arranged adjacent to a front end portion of the first plate at a second angle with respect to the first plate, and comprising a distal end portion arranged spaced apart from the first plate, such that an opening for removing the plurality of playing cards from the receptacle is formed at the front end portion of the first plate between the first surface of the first plate and a first surface of the distal end portion of the second plate facing the first surface of the first plate, wherein the first plate is configured such that the opening between the first plate and the second plate is adjustable by changing a separation between the first plate and the distal end portion of the second plate, wherein the first plate is provided with a spacer element arranged at the front end portion of the first plate and extending along a longitudinal extension of the first plate towards the opening for removing the plurality of playing cards, wherein the spacer element is further arranged to at least partly extend beneath the distal end portion of the second plate, wherein the card shoe further comprises a threaded opening, arranged at a distal end portion of a bottom plate of the support platform, the bottom plate extending substantially parallel to the horizontal reference plane of the support platform, such that the threaded opening is arranged beneath a second surface of the first plate and aligned with the distal end portion of the spacer element, and is configured to receive a screw assembly turnably installed in the threaded opening, the screw assembly being configured to exert an upward force on the second surface of the first plate at the distal end portion of the spacer element by turning of the screw assembly, wherein the turning of the screw assembly in a first direction causes the distal end portion of the spacer element to protrude out of a plane of the first surface of the first plate, thereby changing the separation between the first plate and the distal end portion of the second plate and adjusting the opening between the first plate and the second plate.

14. The card shoe according to claim 13, wherein the first plate comprises a protruding ridge at the front end portion of the first plate, extending outward from the opening between the first plate and the second plate, and wherein the ridge comprises at least one corner portion slanted at an angle with respect to a longitudinal extension of the first plate.

15. The card shoe according to claim 13, wherein the second plate comprises a bifurcated portion extending towards the distal end portion of the second plate such that a substantially U-shaped or V-shaped space is formed along a transverse extension of the second plate.

16. The card shoe according to claim 13, wherein the housing further comprises a cover lid arrangeable at a top side of the housing and covering the receptacle, wherein an inner surface of the cover lid facing the first surface of the first plate comprises a protruding fin at least partly extending along a longitudinal extension of the cover lid.

17. A card shoe comprising:

a housing having an elongated body and comprising a receptacle for receiving a plurality of playing cards, wherein the housing further comprises a first plate arranged on a support platform at a first angle with respect to a horizontal reference plane of the support platform, the first plate having a first surface for supporting the plurality of playing cards, the housing further comprising a second plate arranged adjacent to a front end portion of the first plate at a second angle with respect to the first plate, and comprising a distal end portion arranged spaced apart from the first plate, such that an opening for removing the plurality of playing cards from the receptacle is formed at the front end portion of the first plate between the first surface of the first plate and a first surface of the distal end portion of the second plate facing the first surface of the first plate, wherein the first plate is configured such that the opening between the first plate and the second plate is adjustable by changing a separation between the first plate and the distal end portion of the second plate, wherein the first plate is provided with a spacer element arranged at the front end portion of the first plate and extending along a longitudinal extension of the first plate towards the opening for removing the plurality of playing cards, wherein the spacer element is further arranged to at least partly extend beneath the distal end portion of the second plate, wherein the spacer element is a cut-out contour into the first plate along a cut line extending through an entire thickness of the first plate, such that a proximal end portion of the spacer element is fixedly attached to the first plate and the distal end portion of the spacer element is suspended from the first plate.

18. The card shoe according to claim 17, wherein the first plate comprises a protruding ridge at the front end portion of the first plate, extending outward from the opening between the first plate and the second plate, and wherein the ridge comprises at least one corner portion slanted at an angle with respect to a longitudinal extension of the first plate.

19. The card shoe according to claim 17, wherein the second plate comprises a bifurcated portion extending towards the distal end portion of the second plate such that a substantially U-shaped or V-shaped space is formed along a transverse extension of the second plate.

20. The card shoe according to claim 17, wherein the housing further comprises a cover lid arrangeable at a top side of the housing and covering the receptacle, wherein an inner surface of the cover lid facing the first surface of the first plate comprises a protruding fin at least partly extending along a longitudinal extension of the cover lid.

* * * * *